US010016996B2

(12) United States Patent
Iketani

(10) Patent No.: US 10,016,996 B2
(45) Date of Patent: Jul. 10, 2018

(54) IMAGE FORMING APPARATUS

(71) Applicant: KYOCERA Document Solutions Inc., Osaka (JP)

(72) Inventor: Takeshi Iketani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 728 days.

(21) Appl. No.: 14/622,044

(22) Filed: Feb. 13, 2015

(65) Prior Publication Data

US 2015/0231906 A1 Aug. 20, 2015

(30) Foreign Application Priority Data

Feb. 17, 2014 (JP) ..... 2014-027444

(51) Int. Cl.
*E05C 9/00* (2006.01)
*B41J 29/13* (2006.01)
(Continued)

(52) U.S. Cl.
CPC ..... *B41J 29/13* (2013.01); *E05C 1/08* (2013.01); *G03G 21/1633* (2013.01);
(Continued)

(58) Field of Classification Search
CPC ..... Y10T 292/0834; Y10T 292/0836; Y10T 292/084; Y10T 292/0845; Y10T 292/0846;
(Continued)

(56) References Cited

U.S. PATENT DOCUMENTS 2,486,460 A * 11/1949 Bonenberger ..... E05B 65/0003 292/34
3,596,952 A * 8/1971 Hinkle ..... E05C 9/08 292/124
(Continued)

FOREIGN PATENT DOCUMENTS

JP H10-149077 A 6/1998
JP 2000-098681 A 4/2000
(Continued)

OTHER PUBLICATIONS

The extended European search report issued by the European Patent Office dated Jun. 23, 2015, which corresponds to European Patent Application No. 15155207.2-1560 and is related to U.S. Appl. No. 14/622,044.

*Primary Examiner* — Carlos Lugo
(74) *Attorney, Agent, or Firm* — Studebaker & Brackett PC

(57) ABSTRACT

An image forming apparatus includes a cover and a locking mechanism. The locking mechanism restricts a turning of the cover from a closed position. The locking mechanism has a first locking member, a second locking member and a lever member. The first locking member and the second locking member are movable between a lock position where they engage with the apparatus main body and an unlock position where they disengage with the apparatus main body. The lever member moves the first locking member and the second locking member between the lock position and the unlock position. An engagement quantity of the first locking member with the apparatus main body is larger than that of the second locking member at the lock position. The first locking member is formed with an engaging piece which is turnable by turning of the cover in an opening direction at the unlock position.

10 Claims, 12 Drawing Sheets

(51) Int. Cl.
*G03G 21/16* (2006.01)
*E05C 1/08* (2006.01)

(52) U.S. Cl.
CPC ..... *Y10S 292/38* (2013.01); *Y10T 292/0834* (2015.04); *Y10T 292/0846* (2015.04); *Y10T 292/0967* (2015.04)

(58) Field of Classification Search
CPC ..... Y10T 292/0894; Y10T 292/0895; Y10T 292/0901; Y10T 292/0907; Y10T 292/0961; Y10T 292/0967; Y10S 292/38
See application file for complete search history.

(56) References Cited

U.S. PATENT DOCUMENTS 4,436,201 A * 3/1984 Inaba ..... G11B 23/0328 206/1.5
4,470,276 A * 9/1984 Bayless ..... E05C 7/02 292/37
4,862,641 A * 9/1989 McCarty ..... E05C 19/06 292/262
6,120,069 A * 9/2000 Taranto ..... E05B 83/30 292/166
8,033,582 B2 * 10/2011 Sawatani ..... E05B 83/30 292/140
8,182,000 B2 * 5/2012 Mitchell, Jr. ..... B60R 7/06 292/19
8,590,351 B2 * 11/2013 Ookawara ..... E05B 83/30 292/163
2007/0163310 A1 * 7/2007 Ookawara ..... E05B 83/30 70/208
2010/0246109 A1 9/2010 Matsubara
2015/0069895 A1 3/2015 Tahara

FOREIGN PATENT DOCUMENTS

JP 2004-246063 A 9/2004
JP 2010-199175 A 9/2010
WO 2013/141219 A1 9/2013

* cited by examiner

IMAGE FORMING APPARATUS

INCORPORATION BY REFERENCE

This application is based on and claims the benefit of priority from Japanese Patent application No. 2014-027444 filed on Feb. 17, 2014, the entire contents of which are incorporated herein by reference.

BACKGROUND

The present disclosure relates to an image forming apparatus including a cover openably/closably attached to an apparatus main body.

An image forming apparatus such as a copying machine or a printer includes a cover openably/closably attached to an apparatus main body. The cover is configured to close an inside of the apparatus main body during normal use and to be opened if sheet jamming generated inside of the apparatus main body occurs, for example. Such a cover generally has a supporting shaft at one end side, and is so provided that the other end side opens or is closed around the supporting shaft. Also, the cover is typically provided with a locking mechanism which engages the cover with the apparatus main body at a closed position to restrict the cover from being turnable.

The locking mechanism is often provided to engage the opening/closing side end of the cover with the apparatus main body at both the left and right sides. For example, in a cover that an upper end side is openable/closable around the supporting shaft formed at a lower end side, when the locking mechanisms provided at the left and right sides are released simultaneously at opening the cover, a user can open the cover without feeling uncomfortable. However, if there is a dispersion in dimensions of parts of the cover or the apparatus main body, a clearance quantity is produced in engagement between the cover and the apparatus main body in the left and right locking mechanisms and this may cause a cover half-open state such that one locking mechanism is released and the other locking mechanism is not released.

In contrast with this, there is an image forming apparatus having a locking mechanism including an opening/closing lever, a shaft which turns integrally with the opening/closing lever and a locking member provided at each of the left and right ends of the shaft. In this image forming apparatus, the opening/closing lever is biased in a direction in which the locking members are engaged with the apparatus main body at a closed position so as to maintain a cover at the closed position. When the cover is opened, the shaft is turned by the opening/closing lever, whereby both of the locking members are disengaged from the apparatus main body simultaneously.

In the locking mechanisms of such type as to turn the locking members, since a user tends to turn the shaft more than a quantity in engagement between the cover and the apparatus main body, it becomes possible to release the left and right locking mechanisms simultaneously.

Also, there is an image forming apparatus in which a locking member is provided at a center of a shaft to thereby prevent half-closing of a cover.

However, in the abovementioned locking mechanisms, a space for inserting the user's fingers in order to turn the opening/closing lever is required, and it is impossible to cope with a tendency in recent years requiring more space saving of the image forming apparatus. On the other hand, as locking mechanisms capable of space saving, there also exist locking mechanisms of slide type which slide an opening/closing lever in a vertical direction to disengage a locking member and an apparatus main body from each other. However, as to these locking mechanisms of slide type, there are problems that a cover half-open state easily occurs by a clearance quantity in engagement of the cover with the apparatus main body between the left and right locking mechanisms and a user may feel uncomfortable at the time of opening the cover.

SUMMARY

In accordance with an embodiment of the present invention, an image forming apparatus includes a cover and a locking mechanism. The cover is openably/closably attached to an apparatus main body. The locking mechanism is configured to restrict a turning of the cover from a closed position. The locking mechanism has a first locking member, a second locking member and a lever member. The first locking member and the second locking member are movable between a lock position and an unlock position. At the lock position, the first locking member and the second locking member engage with the apparatus main body to restrict the turning of the cover from the closed position. At the unlock position, the first locking member and the second locking member disengage with the apparatus main body to permit the turning of the cover. The lever member is configured to move the first locking member and the second locking member between the lock position and the unlock position. The first locking member and the second locking member are formed so that an engagement quantity of the first locking member with the apparatus main body is larger than an engagement quantity of the second locking member with the apparatus main body at the lock position. The first locking member is formed with an engaging piece which is turnable by turning of the cover in an opening direction at the unlock position.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 6A and FIG. 6B are transverse sectional views each showing a positional relationship between the back cover and an apparatus main body in the back cover closed position in the printer according to the embodiment of the present disclosure, wherein FIG. 6A shows a left side end, and FIG. 6B shows a right side end.

FIG. 7A and FIG. 7B are views each showing a locking mechanism of the back cover in the printer according to the embodiment of the present disclosure, wherein FIG. 7A is a perspective view and FIG. 7B is an enlarged view of an engaging piece.

FIG. 8A and FIG. 8B are views each showing the locking mechanism at a lock position in the printer according to the embodiment of the present disclosure, wherein FIG. 8A is a plan view and FIG. 8B is a front view.

FIG. 9A and FIG. 9B are views each showing the locking mechanism at an unlock position in the printer according to the embodiment of the present disclosure, wherein FIG. 9A is a plan view and FIG. 9B is a front view.

DETAILED DESCRIPTION

Hereinafter, with reference to figures, an image forming apparatus according to the present invention will be described.

Figure 1:
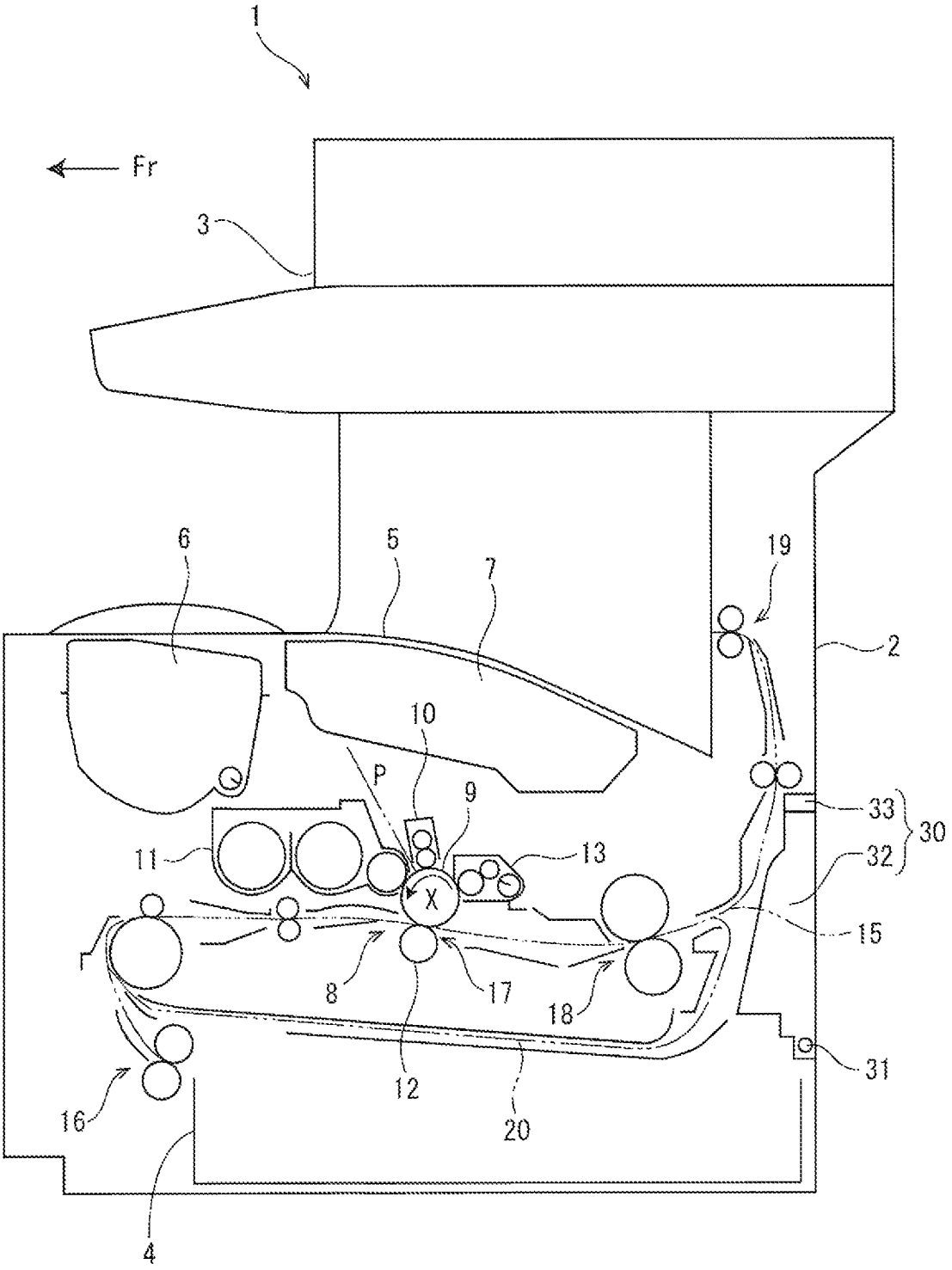
FIG. 1 is a side view schematically showing an internal structure of a printer according to an embodiment of the present disclosure.

First, with reference to FIG. 1, an entire structure of a printer 1 (an image forming apparatus) will be described. FIG. 1 is a sectional view schematically showing an internal structure of the printer according to an embodiment of the present disclosure. Hereinafter, a direction showed by an arrow Fr in FIG. 1 indicates a front side of the printer and left and right directions are described on the basis of a direction when the printer 1 is viewed from the front side.

As shown in FIG. 1, the printer 1 includes a box-like shaped apparatus main body 2. Above the apparatus main body 2, an image reading unit 3 is provided. In a lower part of an inside of the apparatus main body 2, a sheet feeding cartridge 4 storing recording sheets (not shown) is installed and, on an upper face of the apparatus main body 2, a sheet ejecting tray 5 is formed.

Inside the apparatus main body 2, a toner container 6 is installed under the sheet ejecting tray 5. Behind the toner container 6, an exposure device 7 consisting of laser scanning unit (LSU) is provided. Under the exposure device 7, an image forming part 8 is provided. In the image forming part 8, a photosensitive drum 9 as an image carrier is rotatably provided. Around the photosensitive drum 9, a charging device 10, a development device 11, a transfer roller 12 and a cleaning device 13 are located in order along a rotating direction (refer to an arrow X in FIG. 1) of the photosensitive drum 9.

Inside the apparatus main body 2, a conveying path 15 for the recording sheet extending from the sheet feeding cartridge 4 to the sheet ejecting tray 5 is formed. Along the conveying path 15, a sheet feeder 16, a transferring part 17 formed by the photosensitive drum 9 and the transfer roller 12, a fixing device 18 and a sheet ejecting part 19 are provided from an upstream side of the sheet conveying path 15. Under the transferring part 17 and the fixing device 18, an inversion path 20 for duplex printing is formed.

On a back face of the apparatus main body 2, a back cover 30 is provided so as to be turnable around a supporting shaft 31 formed at a lower end. Between the back face of the apparatus main body 2 and a front face of the back cover 30, the sheet conveying path 15 extending from the fixing device 18 to the sheet ejecting part 19 is formed. Opening the back cover 30 makes it possible to treat paper jamming occurred at the sheet conveying path 15.

Next, an image forming operation of the printer 1 having the above structure will be described.

When the power is supplied to the printer 1, initial determination, such as temperature determination of the fixing device 18, is carried out. Subsequently, in the printer 1, when a printing start is directed, image forming operation is carried out as follows.

First, the surface of the photosensitive drum 9 is electric-charged by the charging device 10. Then, photographic exposure corresponding to image data on the photosensitive drum 9 is carried out by a laser light (refer to a two-dot chain line p in FIG. 1) from the exposure device 7, thereby forming an electrostatic latent image on the surface of the photosensitive drum 9. Subsequently, the development device 11 develops the electrostatic latent image to a toner image by a toner (a developer) supplied from the toner container 6.

On the other hand, the recording sheet fed from the sheet feeding cartridge 4 by the sheet feeder 16 is conveyed to the transferring part 17 in a suitable timing for the above-mentioned image forming operation, and then, the toner image on the photosensitive drum 9 is transferred onto the recording sheet in the transferring part 17. The recording sheet with the transferred toner image is conveyed to a downstream side in the conveying path 15 and goes into the fixing device 18, and then, the toner image is fixed on the recording sheet in the fixing device 18. The recording sheet with the fixed toner image is ejected from the sheet ejecting part 19 to the sheet ejecting tray 5. The toner remained on the photosensitive drum 9 is collected by the cleaning device 13.

Figure 2:
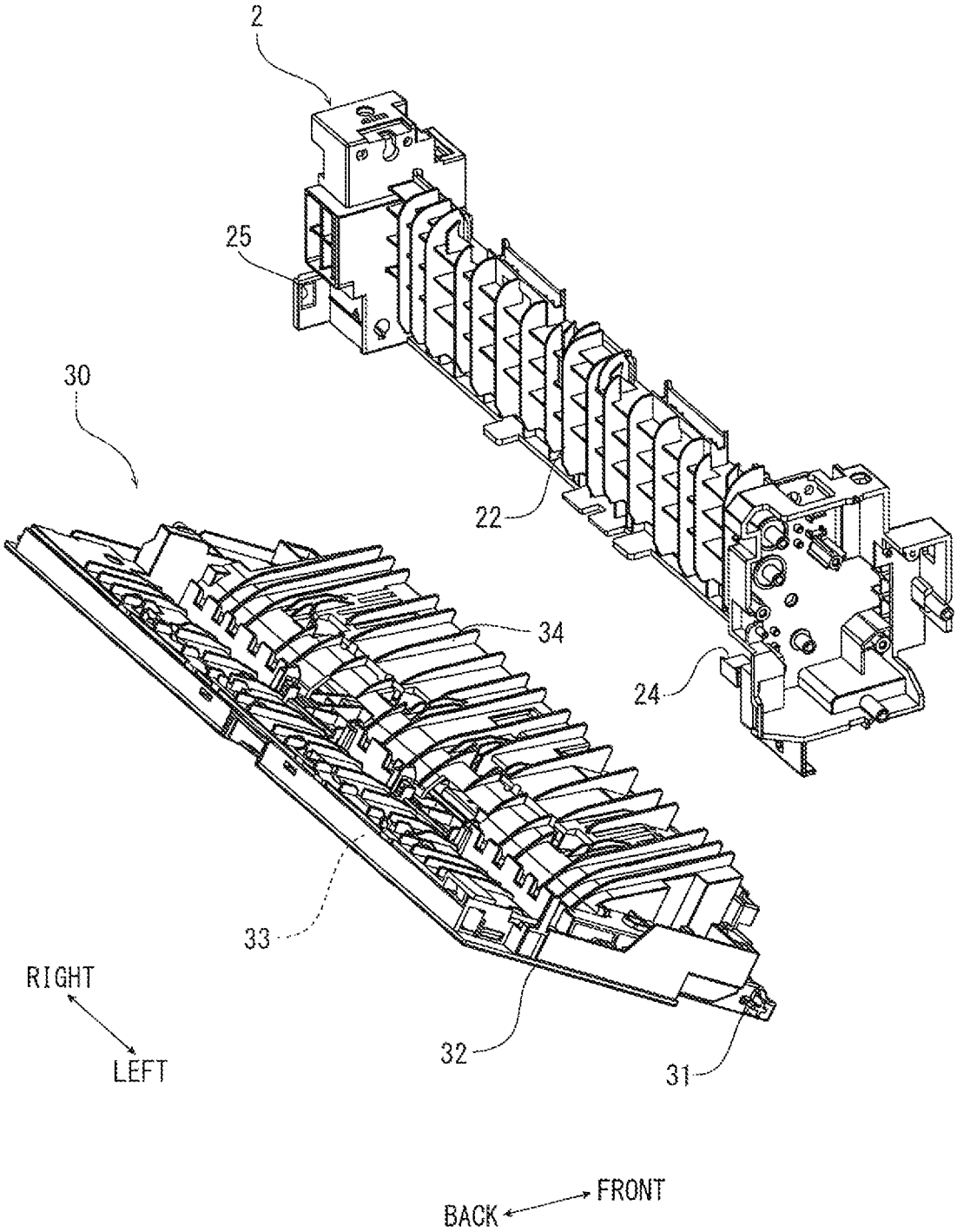
FIG. 2 is a perspective view showing the printer, in a back cover opened position, according to the embodiment of the present disclosure.
Figure 3:
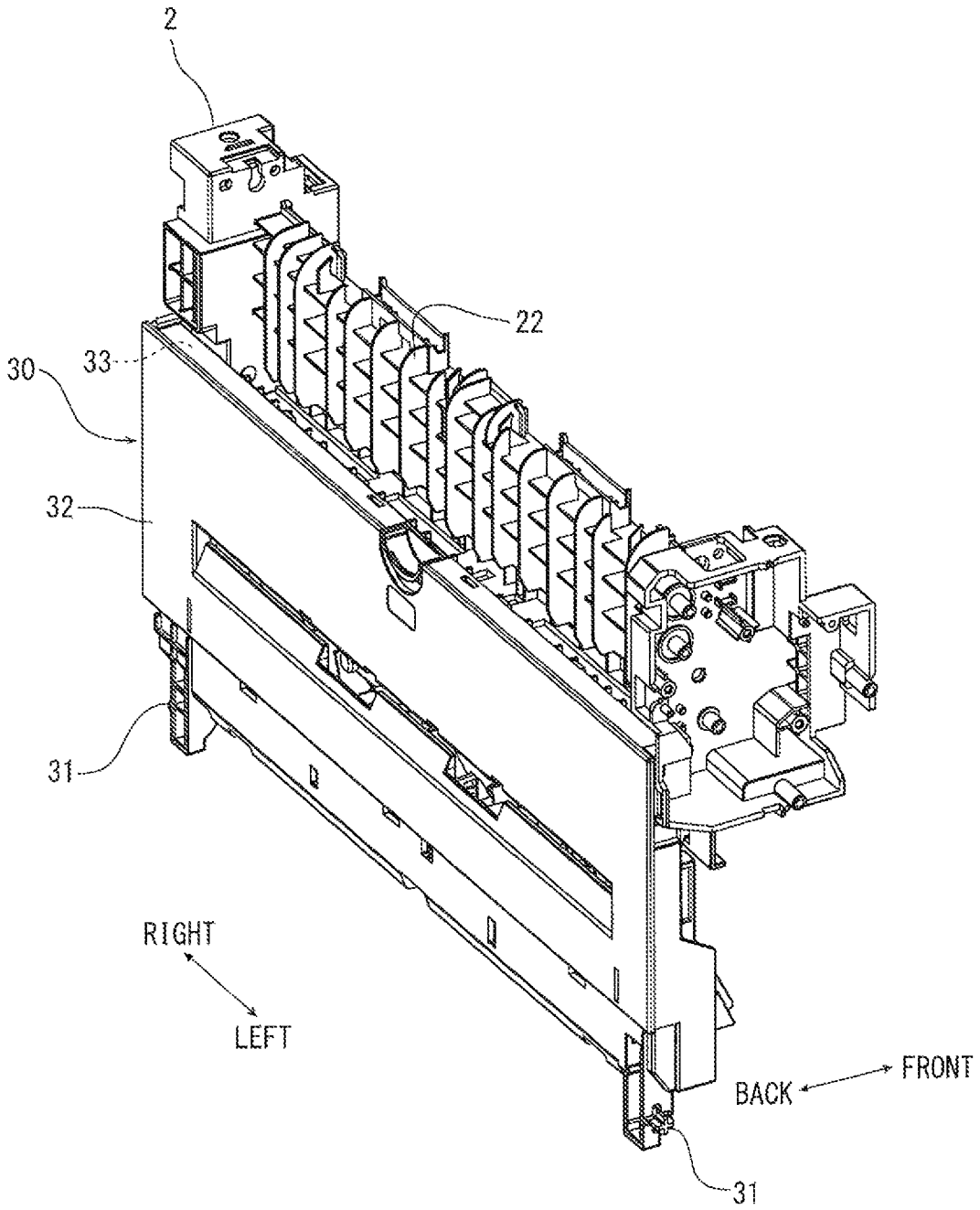
FIG. 3 is a perspective view showing the printer, in a back cover closed position, according to the embodiment of the present disclosure.
Figure 5:
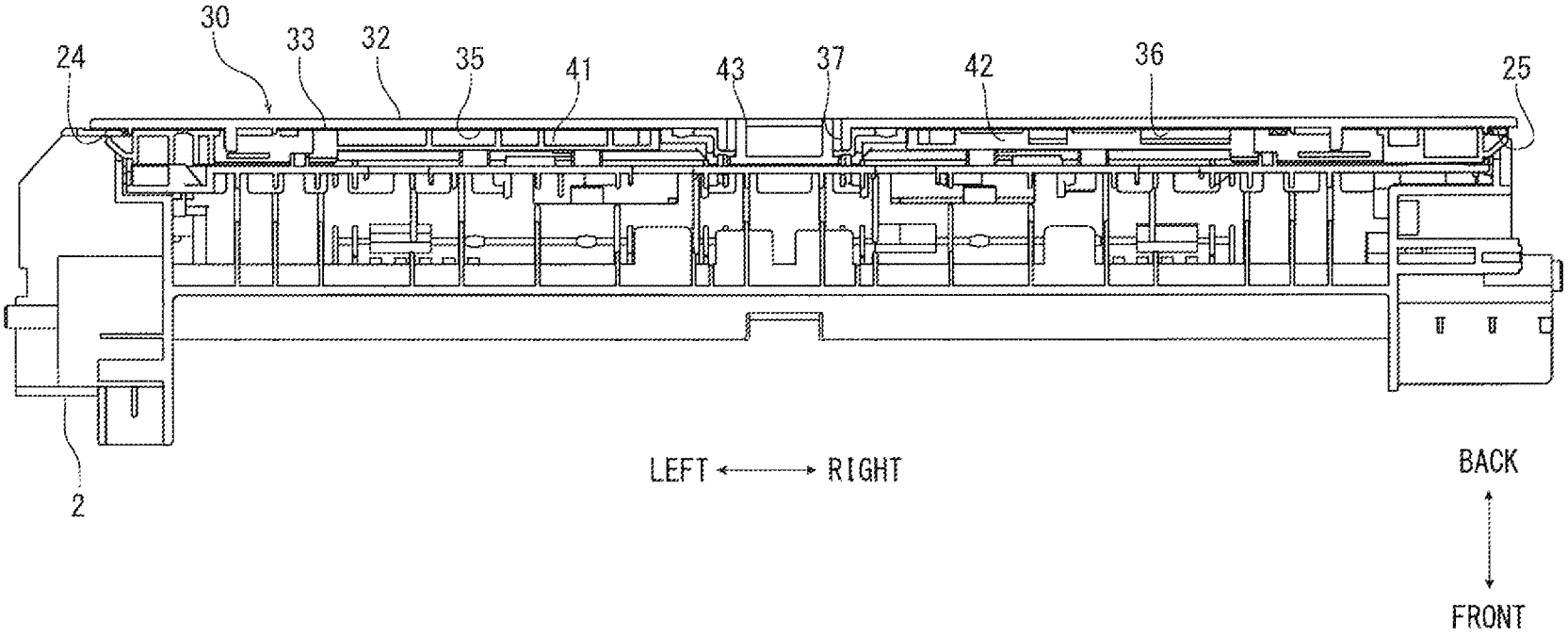
FIG. 5 is a transverse sectional view showing the printer, in the back cover closed position, according to the embodiment of the present disclosure.
Figure 6A:
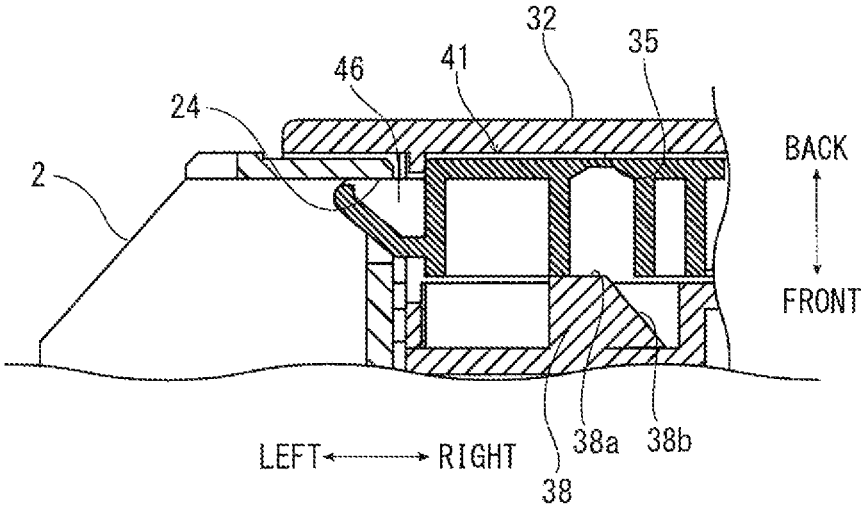
Figure 6B:
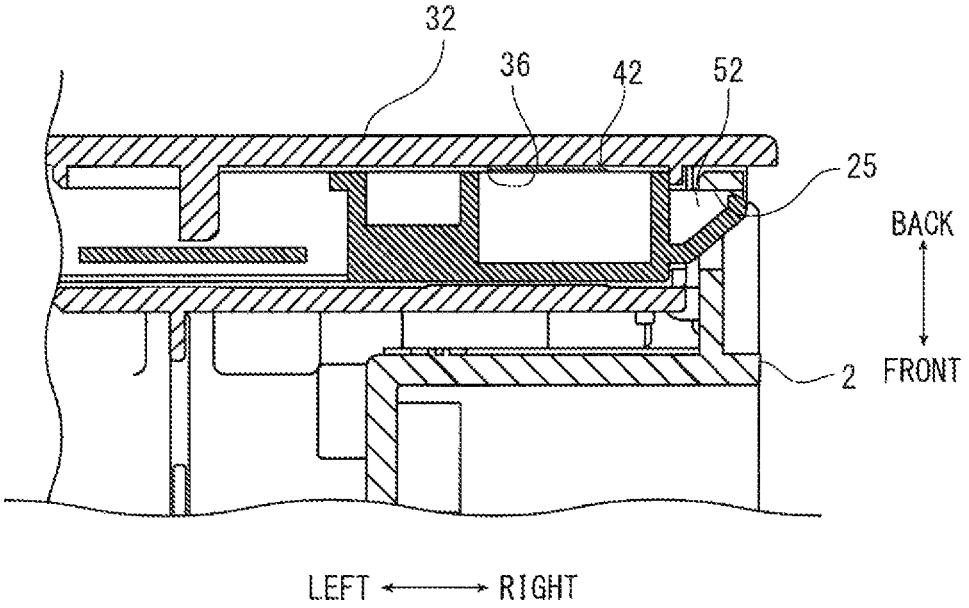

Next, the back cover 30 will be described referring to FIG. 2 to FIG. 6. FIG. 2 is a perspective view showing the back cover at an opened position viewed from a back side, FIG. 3 is a perspective view showing the back cover at a closed position viewed from the back side, FIG. 4 is a front view showing the back cover at the closed position, FIG. 5 is a sectional view at the portion A-A of FIG. 4 showing the cover at the closed position, and FIG. 6A and FIG. 6B are views each showing a positional relationship between the back cover and the apparatus main body in the closed position, wherein FIG. 6A is a plan view showing a left end of the back cover, and FIG. 6B is a plan view showing a right end of the back cover.

The back cover 30, as described previously, is provided on the back face of the apparatus main body 2 so as to be turnable between an opened position (refer to FIG. 2) and a closed position (refer to FIG. 3) around the supporting shaft 31 formed at the lower end thereof. On the back face of the apparatus main body 2, as shown in FIG. 2, a plurality of vertical rib arrays 22 disposed at predetermined intervals in the left and right directions is provided to form one face of the conveying path 15. At lower portions of the left and right end ribs of the rib arrays 22, a first engaging part 24 and a second engaging part 25 which engage with the back cover 30 are respectively formed. The first engaging part 24 and the second engaging part 25 are formed into rectangular apertures penetrating in the left and right directions.

The back cover 30, as shown in FIG. 2 or the like, includes: a main body part (cover) 32 which closes the conveying path 15; and a locking mechanism 33 which maintain the main body part 32 in a posture at which the conveying path 15 is closed and restricts the main body part 32 from opening.

Figure 4:
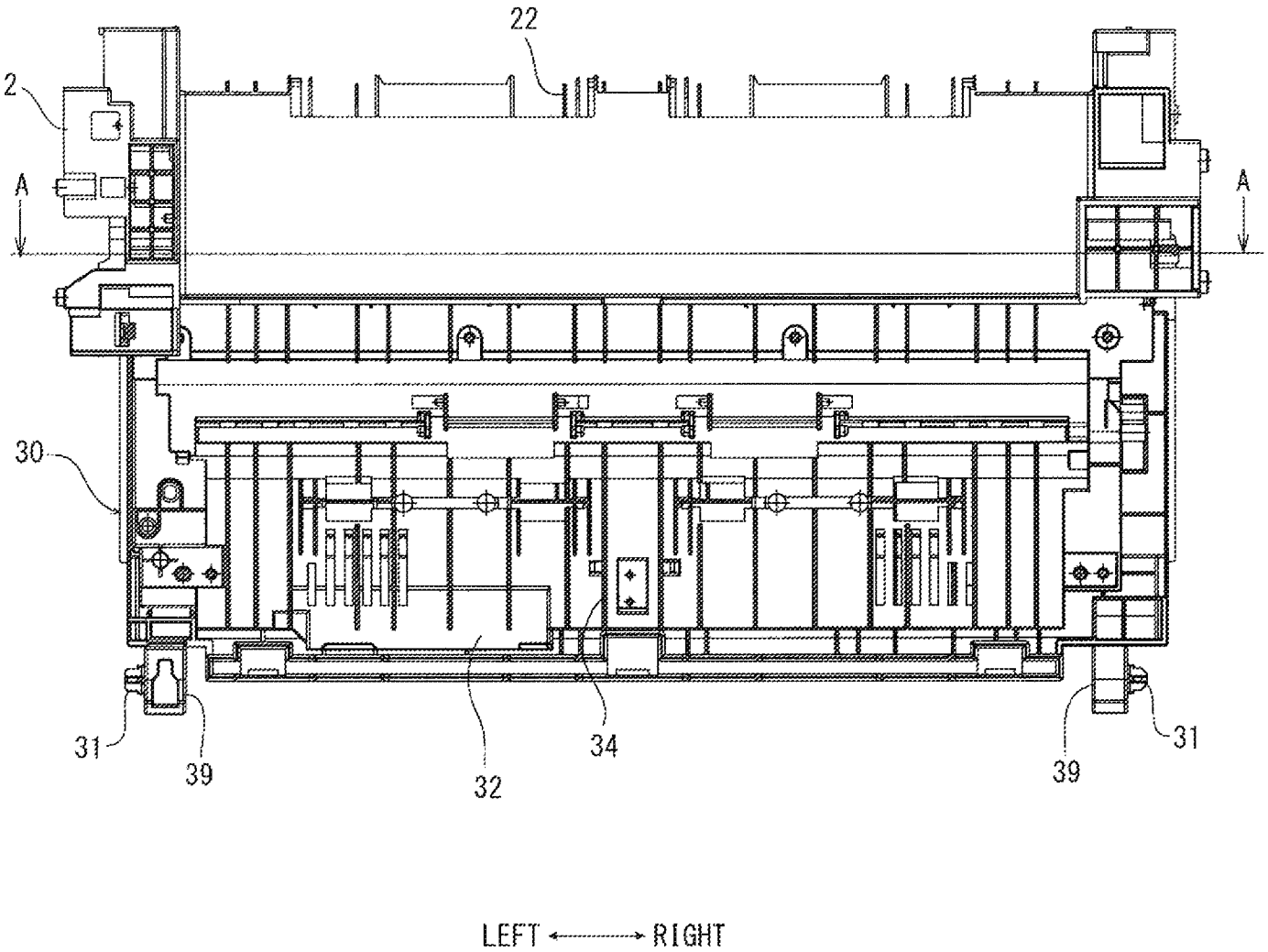
FIG. 4 is a front view showing the printer, in the back cover closed position, according to the embodiment of the present disclosure.

The main body part 32, as shown in FIG. 2 and FIG. 4 or the like, is a transversely elongated plate-shaped member. On a front face of the main body part 32, a plurality of rib arrays 34 extending in an obliquely backward direction from the lower side to the upper side is provided to form the other face of the conveying path 15. The rib arrays 34 of the main body part 32 is provided so as to correspond to the rib arrays 22 provided on the back face of the apparatus main body 2, and between the rib arrays 34 and 22, the sheet is conveyed in an upward direction.

At a left side portion and a right side portion of an upper end face of the main body part 32, as shown in FIG. 5, a left hollow 35 and a right hollow 36 along the left and right directions (directions crossing an opening/closing direction of the back cover 30) are respectively formed. A left end face of the left hollow 35 and a right end face of the right hollow 36 are open. As understandably shown in FIG. 6A and FIG. 6B, the opening of the left hollow 35 and the opening of the right hollow 36 respectively correspond to the first engaging part 24 and the second engaging part 25 which are formed at the apparatus main body 2 when the main body part 32 turns into the closed position. Also, at a center portion of the upper end face of the main body part 32 between the left and right hollows 35 and 36, a center hollow 37 is formed extending downward orthogonal to a longitudinal direction of the left hollow 35 and the right hollow 36. As shown in FIG. 5 or the like, in the left hollow 35, the right hollow 36 and the center hollow 37, a locking mechanism 33 is housed. As shown in FIG. 6A, in the main body part 32, the left hollow 35 is formed with a restricting rib 38 (restricting part) protruding backward at a vicinity of a left end. The restricting rib 38 is a plate-shaped, and has a flat face 38*a* extending in the left and right directions along the left hollow 35 and an inclined face 38*b* inclined from a right end of the flat face 38*a* in a right lower direction, in planar view.

At each of the left and right ends of a lower end face of the main body part 32, as shown in FIG. 4 or the like, a supporting piece 39 is protruded downward. Each of the left and right supporting pieces 39 has supporting shaft 31 protruding leftward and rightward respectively. These supporting shafts 31 are turnably attached at bearings (not shown) provided at the apparatus main body 2 so that the main body part 32 is turnable around the supporting shafts 31 between the closed position at which the conveying path 15 is closed and the opened position at which the conveying path 15 is opened.

Figure 7A:
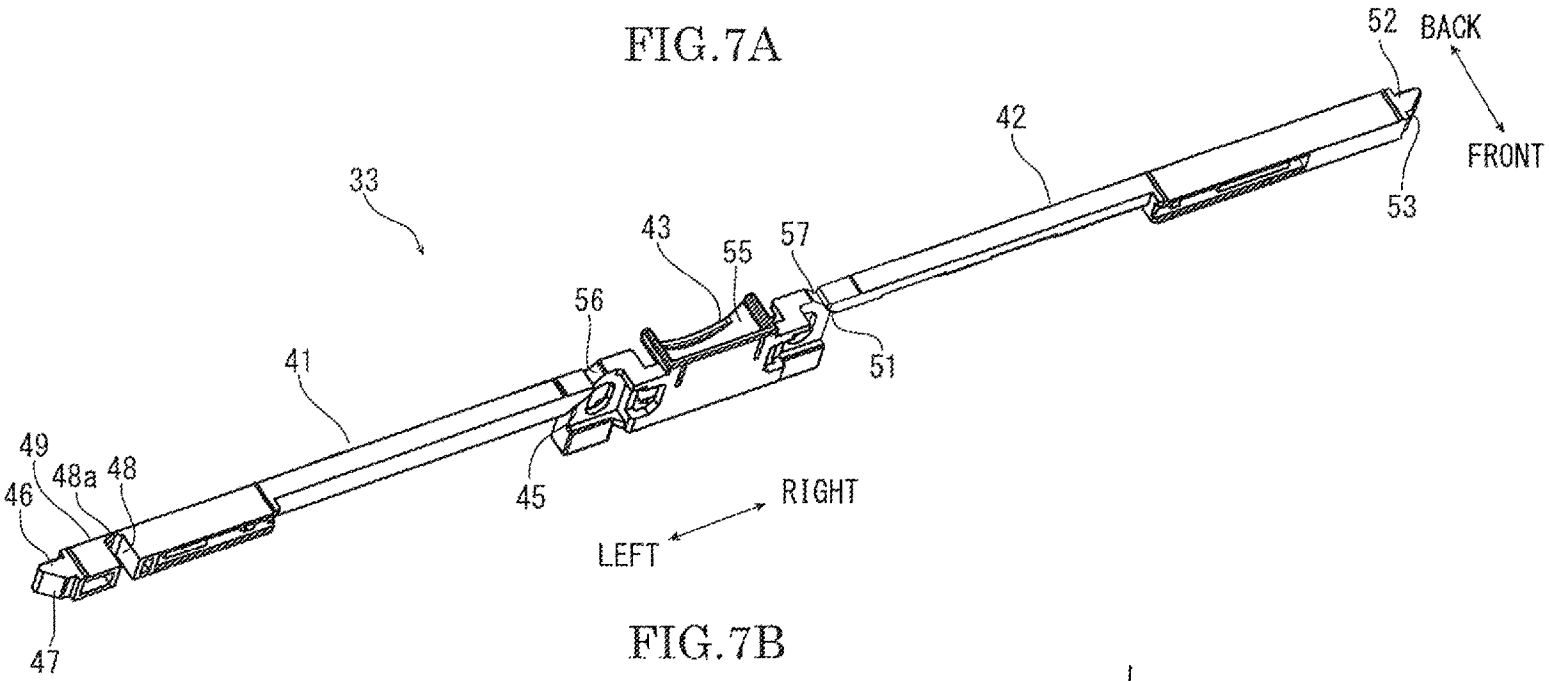
Figure 7B:
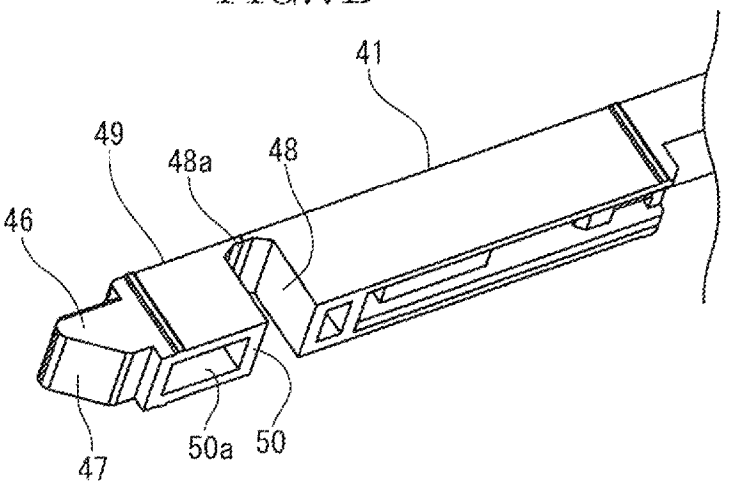
Figure 8A:
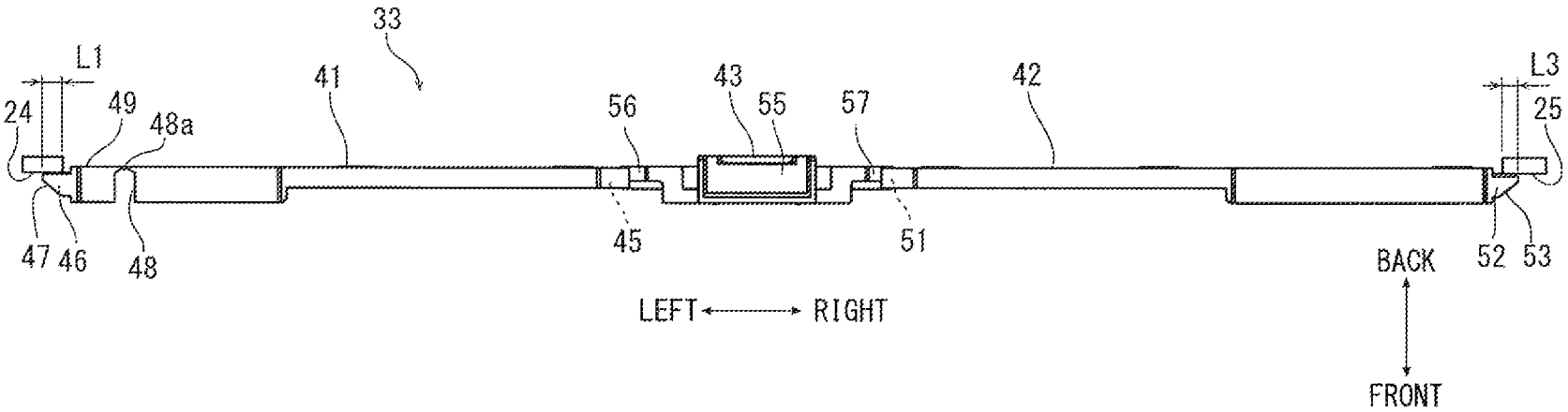
Figure 8B:
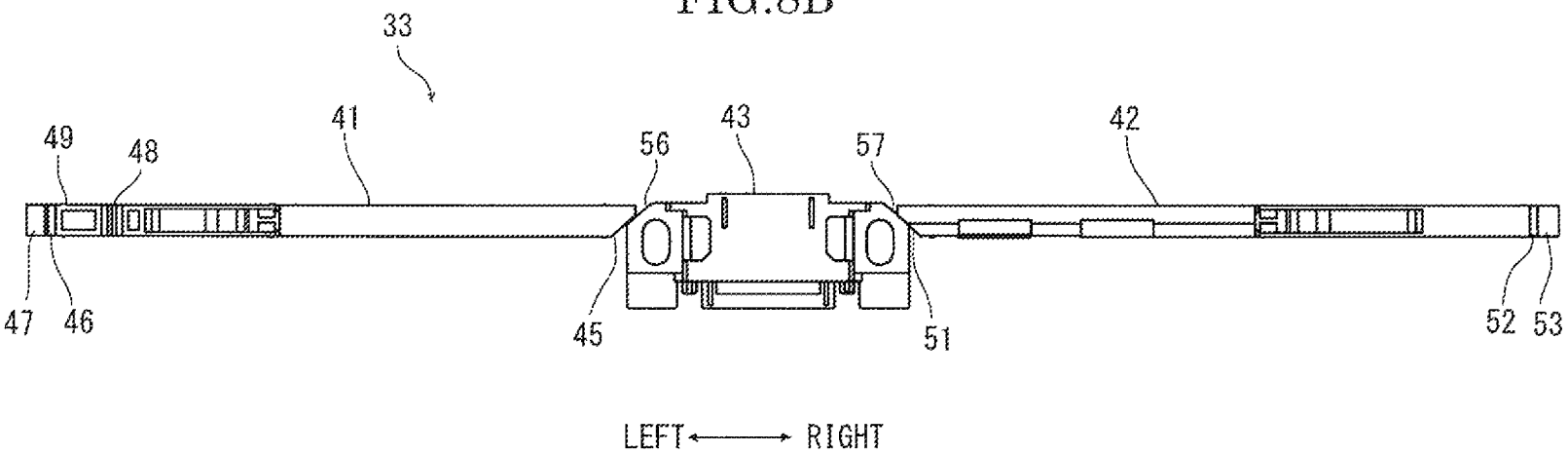
Figure 9A:
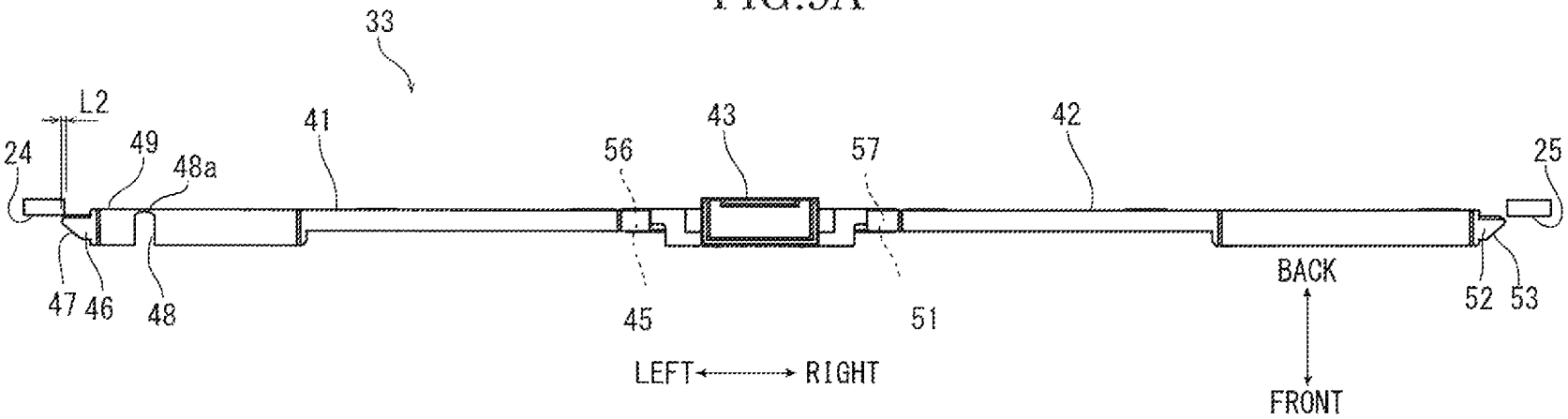
Figure 9B:
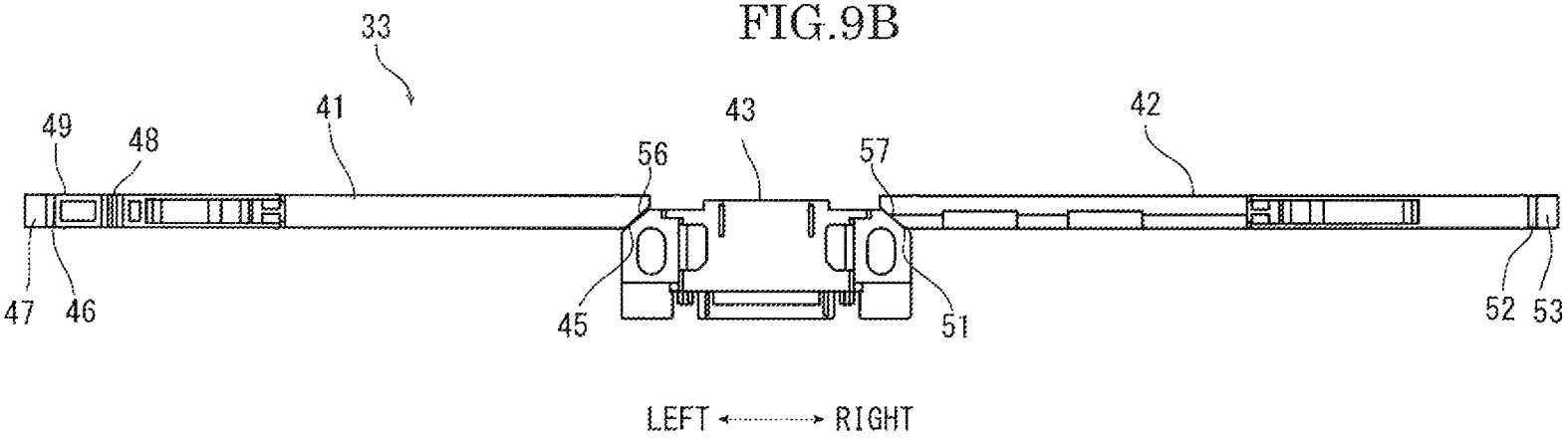

Next, the locking mechanism 33 will be described referring to FIG. 7A, FIG. 7B, FIG. 8A, FIG. 8B, FIG. 9A, and FIG. 8B or the like. FIG. 7A is a perspective view showing the locking mechanism viewed from the front side; FIG. 7B is an enlarged perspective view showing an engaging piece of a first locking member of the locking mechanism; FIG. 8A and FIG. 8B are views each showing the locking mechanism at the back cover closed position, wherein FIG. 8A is a plan view, and FIG. 8B is a front view; and FIG. 9A and FIG. 9B are views each showing the locking mechanism at the back cover opened position, wherein FIG. 9A is a plan view, and FIG. 9B is a front view.

The locking mechanism 33 is disposed along the upper end face of the main body part 32, and has a first locking member 41, a second locking member 42 and a lever member 43. The first and second locking member 41, 42 are configured to be movable between a lock position where they engage with the apparatus main body 2 to restrict the turning of the main body part 32 from the closed position and an unlock position where they disengage with the apparatus main body 2 to permit the turning of the main body part 32 into the opened position. The lever member 43 is configured to be moved in a direction crossing a movement direction of each of the first locking member 41 and the second locking member 42 so as to move the first locking member 41 and the second locking member 42 between the lock position and the unlock position. The first locking member 41, the second locking member 42, and the lever member 43 are formed of a flexible resin such as a polyacetal resin (POM) or a polyamide resin (PA), for example.

The first locking member 41 is a hollow frame-shaped member having a rectangle sectional shape and a length elongated in the left and right directions. The first locking member 41 is formed with a right inclined face 45 inclined in a left lower direction at a corner between a right end face and a bottom face and with a protrusion 46 (engaging part) protruding leftward on a left end face. The protrusion 46 is formed in a hollow frame-shape having a rectangle sectional shape and has a left inclined face 47 (first inclined face) inclined in a left back direction at a corner between the left end face and a front face.

The first locking member 41 is formed with a depression 48 which is cut out in a U-shape in planar view from the front face to the back face at a position slightly rightward from the protrusion 46. A portion (thin part) between a bottom 48*a* of the depression 48 and the back face of the first locking member 41 is thinly formed, and therefore, a portion 49 (engaging piece) on the left side from the depression 48 is turnable in the forward and backward directions around the bottom 48*a* of the depression 48 relative to a portion on the right side of the depression 48. As shown in FIG. 7B, the depression 48 has a wall 50 on the left side, and on a left side of the wall 50, a hollow 50*a* with a front face opened is formed.

The first locking member 41 is supported inside the left hollow 35 formed on the upper end face of the main body part 32 so as to be slidable in the left and right directions. Specifically, the first locking member 41 slides between: the lock position (refer to FIG. 6A and FIG. 8) where the protrusion 46 protrudes leftward from the left opening of the left hollow 35 to comparatively deeply engage with the first engaging part 24 of the apparatus main body 2; and the unlock position (refer to FIG. 9) where the protrusion 46 slightly protrudes leftward from the left opening of the left hollow 35 to comparatively shallowly engage with the first engaging part 24 of the apparatus main body 2. In detail, at the lock position shown in FIG. 8, an engagement quantity L1 between the protrusion 46 and the first engaging part 24 is set so as to be longer than an engagement quantity L2 between the protrusion 46 and the first engaging part 24 at the unlock position shown in FIG. 9. Further, the engagement quantity L2 is set so that, when the main body part 32 turns in an open direction at the unlock position, an engaging piece 49 turns around the bottom 48*a* of the depression 48 and then is spaced away from the first engaging part 24, and thus the engagement of the first locking member 41 with the first engaging part 24 can be released.

The first locking member 41, in the left hollow 35, is biased toward the unlock position (rightward) by a biasing member (not shown).

The second locking member 42 is a hollow frame-shaped member having a rectangle sectional shape and a length elongated in the left and right directions. The second locking member 42 is formed with a left inclined face 51 inclined in a right lower direction at a corner between a left end face and a bottom face and with a protrusion 52 (engaging part) protruding rightward on a right end face. The protrusion 52 is formed in a hollow frame-shape having a rectangle sectional shape and has a right inclined face 53 (first inclined face) inclined in a right back direction at a corner between the right end face and a front face.

The second locking member 42 is supported inside the right hollow 36 formed on the upper end face of the main body part 32 so as to be slidable in the left and right directions. Specifically, the second locking member 42 slides between: the lock position (refer to FIG. 6B and FIG. 8) where the protrusion 52 engages with the second engaging part 25 of the apparatus main body 2; and the unlock position (refer to FIG. 9) where the protrusion 52 is separated away from the second engaging part 25 of the apparatus main body 2. At the lock position shown in FIG. 8, an engagement quantity L3 between the protrusion 52 and the second engaging part 25 is set to be shorter than the engagement quantity L1 between the protrusion 46 of the locking member 41 and the first engaging part 24 at the lock position and to be always spaced away from the second engaging part 25 at the unlock position. Further, a difference (differential engagement quantity) between the engagement quantity L1 and the engagement quantity L3 is set to be larger than an average dispersion quantity in dimensions of the respective parts of the apparatus main body 2 and the back cover 30. The difference between the engagement quantity L1 and the engagement quantity L3 is 0.5 mm, for example.

The second locking member 42, in the right hollow 36, is biased toward the unlock position (leftward direction) by a biasing member (not shown).

The lever member 43 is a rectangular solid-shaped member elongated in the left and right directions and flat in the forward and backward directions. On an upper end face of the lever member 43, a downward-protrusive curved depression 55 is formed. Also, at corners between the upper end face and the left and right side faces of the lever member 43, a left inclined face 56 inclined in a left lower direction from the upper end face and a right inclined face 57 inclined in the right lower direction from the upper end face are respectively formed. The left and right inclined faces 56, 57 are formed so as to respectively correspond to the right inclined face 45 of the first locking member 41 and the left inclined face 51 of the second locking member 42.

The lever member 43 is supported in the center hollow 37 formed on the upper end face of the main body part 32 so as to be slidable in the upward and downward directions. A back opening of the depression 55 of the lever member 43 is formed on the substantially same plane as the back face of the main body part 32. If the lever member 43 slides upward, as shown in FIG. 8, lower portions of the left and right inclined faces 56, 57 engage with respective upper portions of the right inclined face 45 of the first locking member 41 and the left inclined face 51 of the second locking member 42 to slide the first locking member 41 and the second locking member 42 into the lock positions.

Alternatively, if the lever member 43 slides downward, since the first locking member 41 and the second locking member 42 are respectively biased rightward and leftward, as shown in FIG. 9, the right inclined face 45 of the first locking member 41 and the left inclined face 51 of the second locking member 42 respectively run on along the left inclined face 56 and the right inclined face 57 to slide the first locking member 41 and the second locking member 42 into the unlock positions.

The lever member 43 is biased upward by a biasing member (not shown). A biasing force of the biasing member of the lever member 43 is set to be larger than a biasing force of a respective one of the biasing members which bias the first locking member 41 and the second locking member 42 toward the unlock positions. Namely, the lever member 43, at a natural posture, slides the first locking member 41 and the second locking member 42 into the lock positions.

Figure 10A:
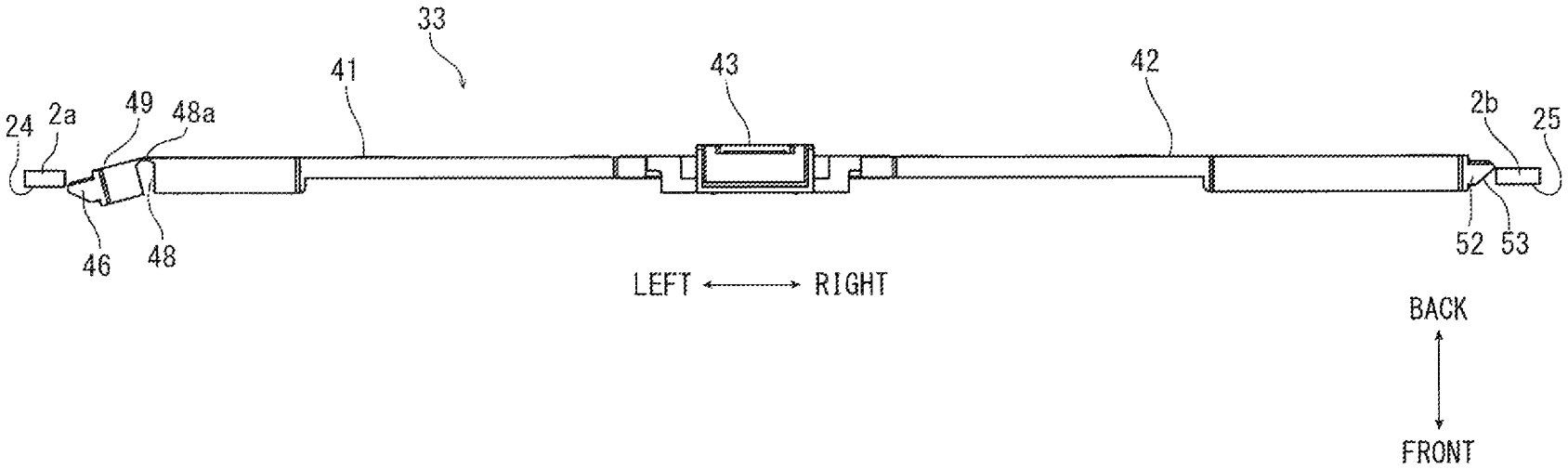
FIG. 10A is a plan view showing the locking mechanism when a main body part is turned, in the printer according to the embodiment of the present disclosure.

An opening/closing action of the back cover 30 having the abovementioned construction will be described referring to FIG. 8A to FIG. 11. FIG. 10 is a plan view showing the locking mechanism at the back cover opened position, and FIG. 11 is a view showing a turning state of the engaging piece. At the back cover closed position, the main body part 32 turns into a substantially vertical posture around the supporting shaft 31 and is locked at the closed position by the locking mechanism 33 so as not to be turnable. That is, as shown in FIG. 8A and FIG. 8B, in the locking mechanism. 33, the first locking member 41 and the second locking member 42 are slid to the respective lock position by the lever member 43 and restrict the turning of the main body part 32 from the closed position. Also, in the first locking member 41, as shown in FIG. 11, a tip end portion of the wall 50 opposes to the flat face 38*a* of the restricting rib 38 of the main body part 32 to restrict the engaging piece 49 from turning in the forward and backward directions around the bottom 48*a*.

If the depression 55 of the lever member 43 is pushed down, as shown in FIG. 9, the first locking member 41 and the second locking member 42 are biased by a respective biasing member and slide into the unlock position. That is, in the second locking member 42, the protrusion 52 is completely spaced away from the second engaging part 25 and therefore the engagement with the second engaging part 25 is released. Meanwhile, in the first locking member 41, a tip end portion of the protrusion 46 is still remained in a shallowly engagement with the first engaging part 24. Also, as indicated by the double-dotted chain line of FIG. 11, the tip end portion of the wall 50 of the first locking member 41 opposes to the inclined face 38*b* of the restricting rib 38 of the main body part 32, and the hollow 50*a* opposes to the flat face 38*a* of the restricting rib 38. This makes the engaging piece 49 possible to be turnable around the bottom 48*a*.

Next, the main body part 32 is turned in an opening direction around the supporting shaft 31 while the depression 55 of the lever member 43 is held down. Then, in the second locking member 42, the protrusion 52 and the second engaging part 25 do not interfere with each other so that the main body part 32 is in a turnable state. Meanwhile, in the first locking member 41, although the protrusion 46 interferes with the first engaging part 24, by applying a force on the main body part 32 in the opening direction, as shown in FIG. 10, the engaging piece 49 including the protrusion 46 turns around the bottom 48*a* of the depression 48 and is then spaced away from the first engaging part 24 along with the turning of the main body part 32. Thus, both the first locking member 41 and the second locking member 42 are completely spaced away from the first engaging part 24 and the second engaging part 25 of the apparatus main body 2 respectively so that the main body part 32 can be turned into the opened position around the supporting shaft 31.

After the first locking member 41 and the second locking member 42 have been spaced away from the apparatus main body 2, if pressing of the lever member 43 is released, the first locking member 41 and the second locking member 42 slide into the lock position. Also, the engaging piece 49, after completely spaced away from the second engaging part 25, returns into its original posture by way of an elastic force.

When the back cover 30 is closed, the main body part 32 is turned into the closed position around the supporting shaft 31. Since the first locking member 41 and the second locking member 42 slide into the lock position, the left inclined face 47 of the protrusion 46 of the first locking member 41 abuts against an wall face 2*a* of the apparatus main body 2 behind the first engaging part 24 and the right inclined face 53 of the protrusion 52 of the second locking member 42 abuts against an wall face 2*b* of the apparatus main body 2 behind the second engaging part 25.

If the main body part 32 is further turned, in the second locking member 42, the second locking member 42 is gradually pressed leftward as the wall face 2*b* abuts the right inclined face 53 of the protrusion 52 from the front to the back. Thus, the lever member 43 slides downward against the biasing force.

Meanwhile, in the first locking member 41, although the protrusion 46 abuts against the wall face 2*a* behind the first engaging part 24, the first locking member 41 is biased rightward along with the downward siding of the lever member 43 by the second locking member 42, and further, the engaging piece 49 turns about the bottom 48*a* of the depression 48.

Afterwards, if the protrusion 46 of the first locking member 41 and the protrusion 52 of the second locking member 42 respectively engage with the first engaging part 24 and the second engaging part 25, the lever member 43 is slid upward by the biasing member to engagingly stop the first locking member 41 and the second locking member 42 into the lock positions. Therefore, the first locking member 41 and the second locking member 42 lock the main body part 32 in the closed position.

As described above, with the printer 1 according to the embodiment of the present disclosure, in the locking mechanism 33 of such a type as to slide the lever member 43 upward or downward to lock and unlock the apparatus main body 2 and the back cover 30, it is possible to open the back cover without causing half-opening. That is, since the engagement quantity L3 between the protrusion 52 of the second locking member 42 and the second engaging part 25 at the lock position is set to be shorter than the engagement quantity L1 between the protrusion 46 of the first locking member 41 and the first engaging part 24 at the lock position, the second locking member 42 is always first disengaged by pressing down the lever member 43. In this state, although the engaging piece 49 of the first locking member 41 shallowly engages with the first engaging part 24, if the main body part 32 is turned in the opening direction afterwards, the engaging piece 49 of the first locking member 41 turns so that the engagement of the first locking member 41 is released.

Figure 10B:
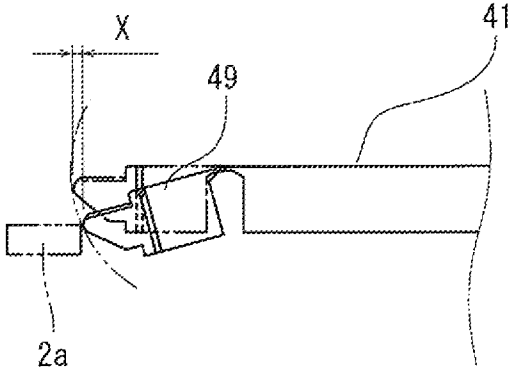
FIG. 10B is a plan view illustrating turning of an engaging piece.
Figure 11:
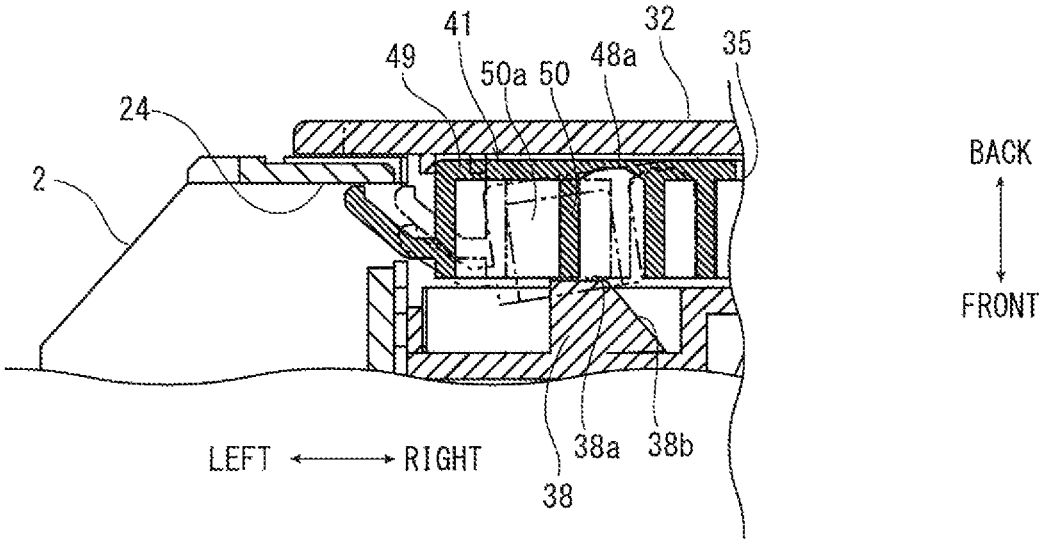
FIG. 11 is a view illustrating a turning state of an engaging piece of a first locking member in the printer according to the embodiment of the present disclosure.

Also, a difference (the engagement quantity L2 of the first locking member 41 at the unlock position) between the engagement quantity L1 and the engagement quantity L3, as shown in FIG. 10B, is a displacement quantity X of a tip end of the engaging piece 49 in a movement direction of the first locking member 41 within a rotational trajectory of the tip end of the engaging piece 49 when the engaging piece 49 of the first locking member 41 turns around the bottom 48*a* of the depression 48, and this value is set to be larger than an average dispersion quantity in dimensions of the respective parts such as the back cover 30 and the apparatus main body 2. Thus, since the engaging piece 49 of the first locking member 41 displaces more significantly than the dispersion quantity, even if there is a dimensional dispersion, the back cover 30 can be opened without causing a half-open state. In addition, the first locking member 41, the second locking member 42, and the lever member 43 are simple shapes, and are easily moldable members. Further, these members are supported by the back cover 30 without requiring a dedicated mounting member, enabling reduction of parts and materials and downsizing of equipment.

Also, the first locking member 41 and the second locking member 41 are respectively housed in the left and right hollows 35, 36 formed at the main body part 32 of the back cover 30, and the lever member 43 is housed in the center hollow 37, thus enabling space saving of the locking mechanism 33.

In addition, although, in the embodiment, the first locking member 41 is formed with the depression 48 so as to cut out in the U-shape from the front face to the back face in order to make the engaging piece 49 of the first locking member 41 turnable, the depression 48 may be formed so as to be cut out in a U-shape from the back face to the front face. However, in consideration of a repetition durability of turning of the engaging piece 49, it is preferable to form the depression 48 so as to be cut out from the front face to the back face. Further, the bottom 48*a* of the depression 48 may be reinforced in consideration of strength. Alternatively, it may be that the engaging piece 49 is formed separately from the locking member 41, and that the engaging piece 49 and the first locking member 41 are turnably connected to each other by an elastic member such as a plate spring.

Figure 12:
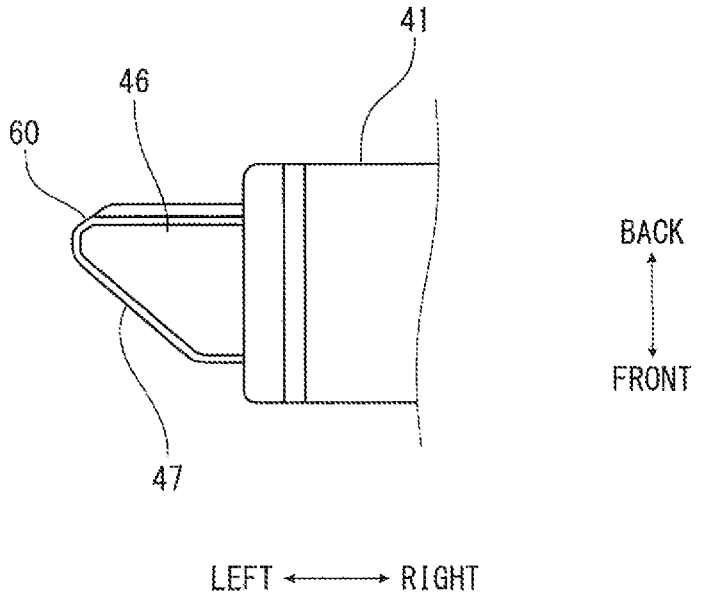
FIG. 12 is a plan view showing another example of a protrusion of the first locking member in the printer according to the embodiment of the present disclosure.

Next, another example of the first locking member 41, in the locking mechanism 33 of the back cover 30 according to the embodiment, will be described referring to FIG. 12. FIG. 12 is a plan view showing a protrusion of the first locking member.

The protrusion 46 of the first locking member 41 is formed with a second inclined face 60 inclined in the right back direction at a corner between the left inclined face 47 and the back face.

In the embodiment, when the main body part 32 is turned, since the second inclined face 60 slides along the wall face 2*a* of the apparatus main body 2 behind the first engaging part 24, the protrusion 46 of the first locking member 41 can smoothly pass through the wall face 2*a*.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

a cover openably/closably attached to an apparatus main body; and a locking mechanism configured to restrict a turning of the cover from a closed position, wherein the locking mechanism has:

a first locking member and a second locking member movable between a lock position where they engage with the apparatus main body to restrict the turning of the cover from the closed position and an unlock position where they disengage with the apparatus main body to permit the turning of the cover; and a lever member configured to move the first locking member and the second locking member between the lock position and the unlock position, and the apparatus main body includes a first engaging part engaging with the first locking member; and a second engaging part engaging with the second locking member, the first locking member includes a protrusion engaging with the first engaging part; an engaging piece deflecting together with the protrusion of the first locking member; and a depression defining a deflecting bottom, the engaging piece is configured to deflect about the deflecting bottom under influence of movement of the cover in an opening direction when the first locking member is at the unlock position, the second locking member includes a protrusion engaging with the second engaging part, the first locking member and the second locking member are formed so that an engagement quantity of the first locking member between the protrusion of the first locking member and the first engaging part is larger than an engagement quantity of the second locking member between the protrusion of the second locking member and the second engaging part when the first locking member and the second locking member are at the lock position, and when the lever member moves the first locking member and the second locking member from the lock position to the unlock position, the protrusion of the second locking member is disengaged from the second engaging part and engagement of the protrusion of the first locking member with the first engaging part is maintained.

2. The image forming apparatus according to claim 1, wherein the first locking member and the second locking member are supported by the cover so as to be movable between the lock position and the unlock position in a direction crossing the opening and closing directions of the cover.

3. The image forming apparatus according to claim 1, wherein the first locking member engages with the first engaging part at the unlock position by a differential engagement quantity which is smaller than the engagement quantity between the protrusion of the first locking member and the first engaging part at the lock position and, the differential engagement quantity is set to be larger than a dimensional dispersion quantity of the apparatus main body, the cover and the locking mechanism.

4. The image forming apparatus according to claim 1, wherein each of the protrusions of the first locking member and the second locking member is formed with a first inclined face between an end face in a direction crossing the opening and closing directions of the cover and a side face on the closing direction side in the opening and closing directions of the cover.

5. The image forming apparatus according to claim 4, wherein each of the protrusions of the first locking member and the second locking member is formed with a second inclined face between the end face in the direction crossing the opening and closing directions and a side face on the opening direction side in the opening and closing directions of the cover.

6. The image forming apparatus according to claim 1, wherein the engaging piece is coupled via the deflecting bottom to one end of the first locking member in the direction crossing the opening and closing directions of the cover, and the engaging piece, the first locking member and the deflecting bottom are integrally molded with a flexible resin material.

7. The image forming apparatus according to claim 6, wherein the deflecting bottom is formed on the opening side in the opening and closing directions of the cover.

8. The image forming apparatus according to claim 1, wherein the apparatus main body is formed with a restricting part which restricts the deflection of the engaging piece at the lock position and permits the deflection of the engaging piece at the unlock position.

9. The image forming apparatus according to claim 1, wherein the lever member slides along the cover in a direction crossing the movement directions of the first locking member and the second locking member to move the first locking member and the second locking member between the lock position and the unlock position.

10. The image forming apparatus according to claim 9, wherein the first locking member, the second locking member and the lever member are supported by a hollow provided at the cover, and the lever member slides in upward and downward directions to move the first locking member and the second locking member between the lock position and the unlock position in a direction opposite to each other in leftward and rightward directions.

* * * * *